US010145151B2

(12) United States Patent
Da Deppo et al.

(10) Patent No.: US 10,145,151 B2
(45) Date of Patent: Dec. 4, 2018

(54) RETENTION MECHANISM FOR VEHICULAR DOOR HANDLE ASSEMBLY

(71) Applicant: Huf North America Automotive Parts Manufacturing Corp., Milwaukee, WI (US)

(72) Inventors: Lynn D. Da Deppo, Bloomfield Hills, MI (US); Ehab Kamal, Novi, MI (US); Suat Kaya, Novi, MI (US); Yusuf Yankioglu, Ypsilanti, MI (US)

(73) Assignee: Huf North America Automotive Parts Manufacturing Corp., Milwaukee, WI (US)

( * ) Notice: Subject to any disclaimer, the term of this patent is extended or adjusted under 35 U.S.C. 154(b) by 268 days.

(21) Appl. No.: 15/140,651

(22) Filed: Apr. 28, 2016

(65) Prior Publication Data

US 2016/0319573 A1 Nov. 3, 2016

Related U.S. Application Data

(60) Provisional application No. 62/155,201, filed on Apr. 30, 2015.

(51) Int. Cl.
*E05B 79/06* (2014.01)
*E05B 85/16* (2014.01)

(52) U.S. Cl.
CPC ..... *E05B 79/06* (2013.01); *E05B 85/16* (2013.01)

(58) Field of Classification Search
CPC ..... E05B 79/00; E05B 79/02; E05B 79/04; E05B 79/06
See application file for complete search history.

(56) References Cited

U.S. PATENT DOCUMENTS 6,401,302 B1 * 6/2002 Josserand ..... E05B 79/06 16/444
6,523,871 B1 * 2/2003 Josserand ..... E05B 79/06 292/347
6,749,236 B2 * 6/2004 Nomura ..... E05B 85/16 16/412
7,146,832 B2 * 12/2006 Mathofer ..... E05B 79/06 70/208
7,260,964 B2 * 8/2007 Velicanin ..... E05B 79/06 292/336.3

(Continued)

*Primary Examiner* — Christopher J Boswell
(74) *Attorney, Agent, or Firm* — Honigman Miller Schwartz and Cohn LLP; Matthew H. Szalach; Jonathan P. O'Brien

(57) ABSTRACT

A door handle assembly for a door of a vehicle includes a bracket mountable to the door and extending along a longitudinal direction from a forward end to a rearward end. The forward end of the bracket provides a hook portion. A door retaining member is received proximate the rearward end of the bracket. The door retaining member has a clip portion which is moveable relative to the bracket between a home position and a displaced position. A first longitudinal distance is established between the clip portion and the hook portion in the home position, and a second longitudinal distance is established in the displaced position. The first longitudinal distance is different than the second longitudinal distance. A biasing member biases the door retaining member toward the home position and permits the movement of the door retaining member against the biasing member to the displaced position.

20 Claims, 7 Drawing Sheets

(56) References Cited

U.S. PATENT DOCUMENTS

| | | | | |
|---|---|---|---|---|
| 7,556,296 | B2 * | 7/2009 | Kondo | E05B 85/16 292/336.3 |
| 7,575,269 | B2 * | 8/2009 | Kobayashi | E05B 79/06 296/146.1 |
| 8,783,743 | B2 * | 7/2014 | Park | E05B 85/16 292/336.3 |
| 9,435,137 | B2 * | 9/2016 | Kilian | B60R 25/066 |
| 9,644,394 | B2 * | 5/2017 | Breimayer | E05B 79/06 |
| 9,650,806 | B2 * | 5/2017 | Beck | E05B 3/04 |
| 9,708,838 | B2 * | 7/2017 | Nagata | E05B 79/08 |
| 9,803,402 | B2 * | 10/2017 | Ichikawa | E05B 85/16 |

* cited by examiner

RETENTION MECHANISM FOR VEHICULAR DOOR HANDLE ASSEMBLY

CROSS REFERENCES TO RELATED APPLICATIONS

This application Claims the benefit of U.S. Provisional Patent Application Ser. No. 62/155,201, filed Apr. 30, 2015, the entire contents of which are hereby incorporated by reference.

FIELD

This disclosure is related to assemblies for vehicle door handles and, more specifically, to improved assemblies for the retention of brackets, lock cylinders, and associated components in handle assemblies.

BACKGROUND

This section provides background information related to the present disclosure which is not necessarily prior art.

Current vehicle door handle systems typically include a door handle assembly with a pull strap, pivoting flap or other type of door latch activating device and a bracket or housing holding the handle. The bracket or housing is typically affixed to sheet metal of a vehicle door using a mechanical fastener such as a screw or bolt. Once the bracket is attached to the sheet metal, the remaining components of the door handle assembly may then be attached to the door via the bracket. For example, the pull strap may be assembled to the bracket and additional hardware relating to any locking or latching mechanisms can be installed, if necessary. Once assembled and in use, the pull strap may be pulled relative to the bracket to unlatch the door, although it will be appreciated that variations might be implemented on this basic operation (for example, a grip may need to be first displaced before pulling, one or more sensors may be incorporated to detect the presence of a hand, etc.).

The method of attachment of the bracket to the door can be time consuming and labor intensive. The method typically involves the proper fore/aft positioning of the bracket relative to the door followed by the fastening of one or more screws or bolts to fix the bracket in place relative to the door. The use of threaded fasteners typically requires the use of powered drivers during assembly, which can be time-consuming and require dexterity to drive the fasteners. Further, the fasteners may be sensitive to proper torque application in order to ensure long-term retention of the fore/aft positioning of the bracket relative to the door. Torque sensors may be necessary to ensure that the screw or bolt has been properly tightened to secure the bracket to the door without causing damage to either component. In sum, while mechanical fasteners adequately attach a bracket of a door handle system to a vehicle door, such fasteners add to the overall cost and complexity associated with attaching a handle system to a vehicle door and, therefore, add to the overall cost and complexity associated with assembling a vehicle.

SUMMARY

This section provides a general summary of the disclosure, and is not a comprehensive disclosure of its full scope or all of its features.

In view of the above state of the art, improvements in securing the bracket to the door might be helpful to improve the accuracy of the placement of the bracket relative to the door and to reduce the amount of or to adjust the type of manual labor associated with assembly. Disclosed herein is an improved bracket for a door handle assembly that foregoes conventional bolt or screw fastening. Instead, the bracket is designed to have opposing clips or hooks that provide for the installation of the bracket to a door without the use of a tool, whereby at least one of the clips or hooks is temporarily movable to accommodate assembly. This design may also incorporate features that accommodate the reception of an insertion member which may be, for example, a locking element for the door such as a keyed cylinder lock without the use of a tool.

Thus, the present disclosure provides a vehicle door handle assembly including a bracket and handle assembly, where the bracket is affixed to the vehicle via the application of hooks and force biasing of an interlocking device or mechanism. Retention of the outside door handle assembly without the need for affixing fasteners and through the sequencing of biasing members of the assembly is achieved.

In one embodiment of the disclosure, a door handle assembly for a door of a vehicle is provided. The door handle assembly includes a bracket mountable to the door and extending along a longitudinal direction from a forward end to a rearward end. The forward end of the bracket provides a hook portion. A door retaining member is received proximate the rearward end of the bracket. The door retaining member has a clip portion that is moveable relative to the bracket between a home position and a displaced position. In the home position, a first longitudinal distance is established between the clip portion and the hook portion. In the displaced position, a second longitudinal distance is established between the clip portion and the hook portion. The first longitudinal distance is different than the second longitudinal distance. The door handle assembly further includes a biasing member biasing the door retaining member toward the home position and permitting the movement of the door retaining member against the biasing member to the displaced position.

The first longitudinal distance between the clip portion and the hook portion, in some forms, may be greater than the second longitudinal distance between the clip portion and the hook portion.

In some forms, during assembly of the bracket into the door, the hook portion on the forward end may be received at a hook receiving portion of the door. The bracket may then be rotated about the hook portion until the clip portion is received at a clip receiving portion of the door. As the clip portion passes through the clip receiving portion of the door, the door retaining member is moved from the home position to the displaced position against a biasing force to permit passage through the clip receiving portion. After the clip portion has passed through the clip receiving portion of the door, the door retaining member can return towards the home position to secure the bracket to the door by the combination of the hook portion and the door retaining member. In some forms, the bracket is mountable to the door without the use of tools.

The door handle assembly may further include a retaining mechanism received by the bracket. The retaining mechanism may include the biasing member and a movable locking member. In some forms, the biasing member may be a coiled spring or a leaf spring interposed between the bracket and the movable locking member.

An insertion member may be received in and retained in the bracket by the movable locking member. In some forms, the insertion member is assembled into the bracket via the retaining mechanism without the use of tools. Insertion of the insertion member into the bracket may cause the movable locking member to temporarily overcome a biasing force of the biasing member over a portion of an insertion distance until the insertion member is fully received in the bracket. At this point, the biasing force causes the movable locking member to snap back and lock in place, thereby causing the movable locking member to retain the insertion member in the bracket and not be withdrawn.

In some forms, the movable locking member may translationally slide in a direction generally perpendicular to the direction of insertion of the insertion member into the bracket. In some forms, the movable locking member and the door retaining member may be integrally formed (although they may also be separate pieces from one another, even if they are coupled together or share the same biasing member). Movement of the door retaining member between the home position and the displaced position may be a translational movement. In one form, the translational movement of the door retaining member is linear along the longitudinal direction. However, in some forms, the movement of the door retaining member is rotational.

The insertion member, in some forms, may include an engagement surface that engages the clip portion of the door retaining member as the insertion member is received in the bracket to inhibit the door retaining member from moving out of the home position in the longitudinal direction. To accommodate temporary displacement of the movable locking member during insertion of the insertion member, the insertion member or the movable locking member may have a profiled surface and the other of the insertion member and the movable locking member may have a projection. The profiled surface and the projection are shaped and positioned to engage one another during an insertion of the insertion member into the bracket. Engagement of the projection with the profiled surface during insertion of the insertion member into the bracket may temporarily displace the movable locking member from a securing position against the biasing force of the biasing member in order to permit the insertion member to be received in the bracket. Then, when the insertion member is fully inserted into the bracket, the profiled surface and the projection can be shaped such that the movable locking member is biased back into the securing position in order to retain the insertion member into the bracket. As one example, the insertion member may include the profiled surface that includes ramps. However, this might be reversed. In one specific form, the movable locking member may be generally U-shaped with two legs on opposing sides of the insertion member with projections facing the insertion member. The ramps of the insertion member may be formed in channels in opposing sides of the insertion member.

In one form, the hook portion may be fixed relative to the bracket. In another form, the hook portion may be integral with the bracket. The hook portion may be engageable with a hook receiving portion on the door to mount the bracket to the door.

A spatial displacement of the door retaining member away from the home position may compress the biasing member and coincidentally translate the movable locking member forward (i.e., closer to the forward end of the bracket) as the door retaining member moves against the biasing member to the displaced position. In some forms, the door retaining member may be coupled to the movable locking member such that the movable locking member moves with the door retaining member, even if they are separate components.

A related method of assembly of a door handle is also provided. The door handle includes a bracket mountable to the door and extending along a longitudinal direction from a forward end to a rearward end. The forward end of the bracket provides a hook portion. The door handle further includes a door retaining member received proximate the rearward end of the bracket and having a clip portion. The door handle also includes a biasing member. The method includes engaging the hook portion provided on the forward end of the bracket with a hook receiving portion of the door. The bracket is rotated about the hook portion until the clip portion is received at a clip receiving portion in the door. The clip portion of the door retaining member is moved from a home position in which a first longitudinal distance is established between the clip portion and the hook portion toward a displaced position in which a second longitudinal distance is established between the clip portion and the hook portion. This occurs as the clip portion is moved against a biasing force by passing the clip portion through the clip receiving portion of the door. After the clip portion is received through the clip receiving portion of the door, the door retaining member is returned towards the home position to secure the bracket to the door by the combination of the hook portion and the door retaining member.

According to another aspect, a door handle assembly for a door of a vehicle may include a bracket and a door retaining member. The bracket is mountable to the door and extends along a longitudinal direction from a forward end to a rearward end, the forward end of the bracket providing a hook portion. The door retaining member received proximate the rearward end of the bracket and having a clip portion that is moveable relative to the bracket between a home position and a displaced position. In order to provide movement between these two positions, the door retaining member may include an elastically deformable or flexible portion that permits the clip portion to be temporarily displaced from the home position during the assembly of the bracket to the door and which then facilitates the snapping back to the home position.

In another configuration, a door handle assembly for a door is provided and includes a bracket mountable to the door and extending along a longitudinal direction from a forward end to a rearward end, whereby the forward end of the bracket provides a hook portion. A door retaining member is received proximate the rearward end of the bracket and includes a clip portion. The clip portion is moveable relative to the bracket between a home position in which a first longitudinal distance is established between the clip portion and the hook portion and a displaced position in which a second longitudinal distance is established between the clip portion and the hook portion, whereby the first longitudinal distance is different than the second longitudinal distance A biasing member biases the clip portion toward the home position and permits movement of the clip portion against the biasing member to the displaced position.

In one configuration, the hook portion may be fixed relative to the bracket. In addition or alternatively, the second longitudinal distance may be less than the first longitudinal distance.

A locking member may be movable relative to the bracket between an extended position and a retracted position. The locking member may be biased into the extended position by the biasing member. The locking member may be fixed for movement with the door retaining member. An insertion member may support a component of the handle assembly, whereby the insertion member includes a retention feature that engages the locking member to attach the insertion member to the bracket. The insertion member may include at least one ramped surface that engages the locking member to move the locking member from the extended position to the retracted position against the bias exerted on the locking member by the biasing member. The locking member may disengage the at least one ramped surface when the insertion member is moved a predetermined distance into the bracket and returns to the extended position to attach the insertion member to the bracket. In one configuration, the component of the handle assembly is at least one of a lock cylinder and a cover cap.

In another configuration, a door handle assembly for a door is provided and includes a bracket mountable to the door and a door retaining member including a clip portion that is moveable relative to the bracket between a home position and a displaced position, whereby the clip portion attaches the bracket to the door in the home position. A locking member is supported by the bracket, is movable between an extended position and a retracted position, and attaches a component of the door handle assembly to the bracket in the extended position. A biasing member biases the clip portion toward the home position and permits movement of the clip portion against the biasing member to the displaced position and biases the locking member toward the extended position and permits movement of the locking member against the biasing member to the retracted position.

In one configuration, the bracket may include a hook portion that engages the door proximate to a first end of the bracket. The hook portion may be fixed relative to the bracket. A first longitudinal distance may be established between the clip portion and the hook portion when the clip portion is in the home position and a second longitudinal distance may be established between the clip portion and the hook portion when the clip portion is in the displaced position, whereby the first longitudinal distance is different than the second longitudinal distance. In one configuration, the first longitudinal distance may be greater than the second longitudinal distance.

In one configuration, the locking member may be fixed for movement with the door retaining member.

An insertion member may operably support the component of the handle assembly and may include a retention feature that engages the locking member to attach the insertion member to the bracket. The insertion member may include at least one ramped surface that engages the locking member to move the locking member from the extended position to the retracted position against the bias exerted on the locking member by the biasing member. The locking member may disengage the at least one ramped surface when the insertion member is moved a predetermined distance into the bracket and may return to the extended position to attach the insertion member to the bracket. The component of the handle assembly may be at least one of a lock cylinder and a cover cap.

Further areas of applicability will become apparent from the description provided herein. The description and specific examples in this summary are intended for purposes of illustration only and are not intended to limit the scope of the present disclosure.

BRIEF DESCRIPTION OF THE DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION OF THE DISCLOSURE

Figure 1:
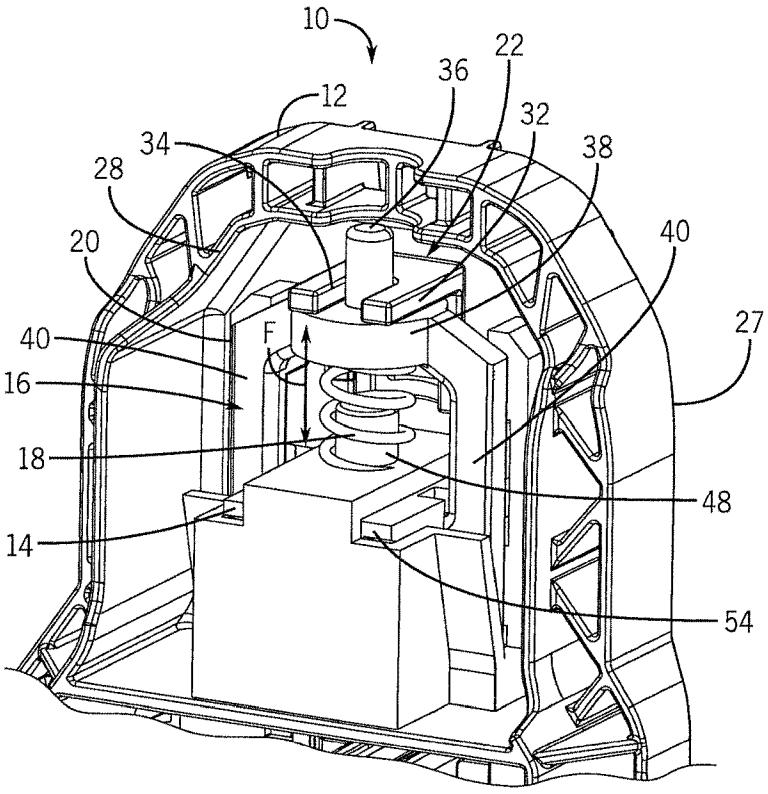
FIG. 1 is a rear perspective view of a rearward portion of a door handle assembly according to the present disclosure.

Example embodiments will now be described more fully with reference to the accompanying drawings. Example embodiments are provided so that this disclosure will be thorough, and will fully convey the scope of those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of moded features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Figure 2:
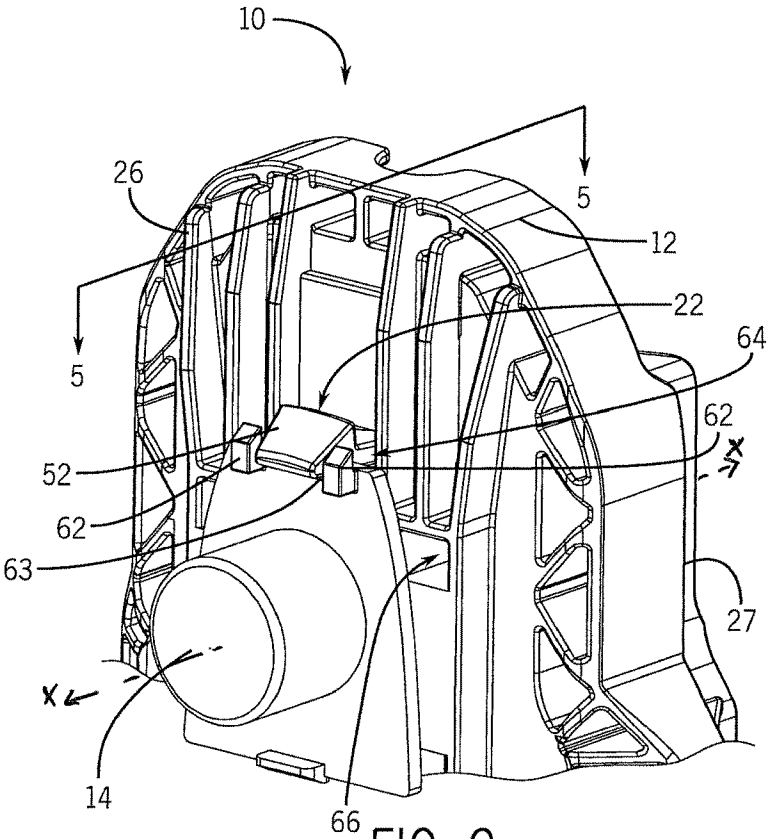
FIG. 2 is a front perspective view of the rearward portion of the door handle assembly of FIG. 1.
Figure 3:
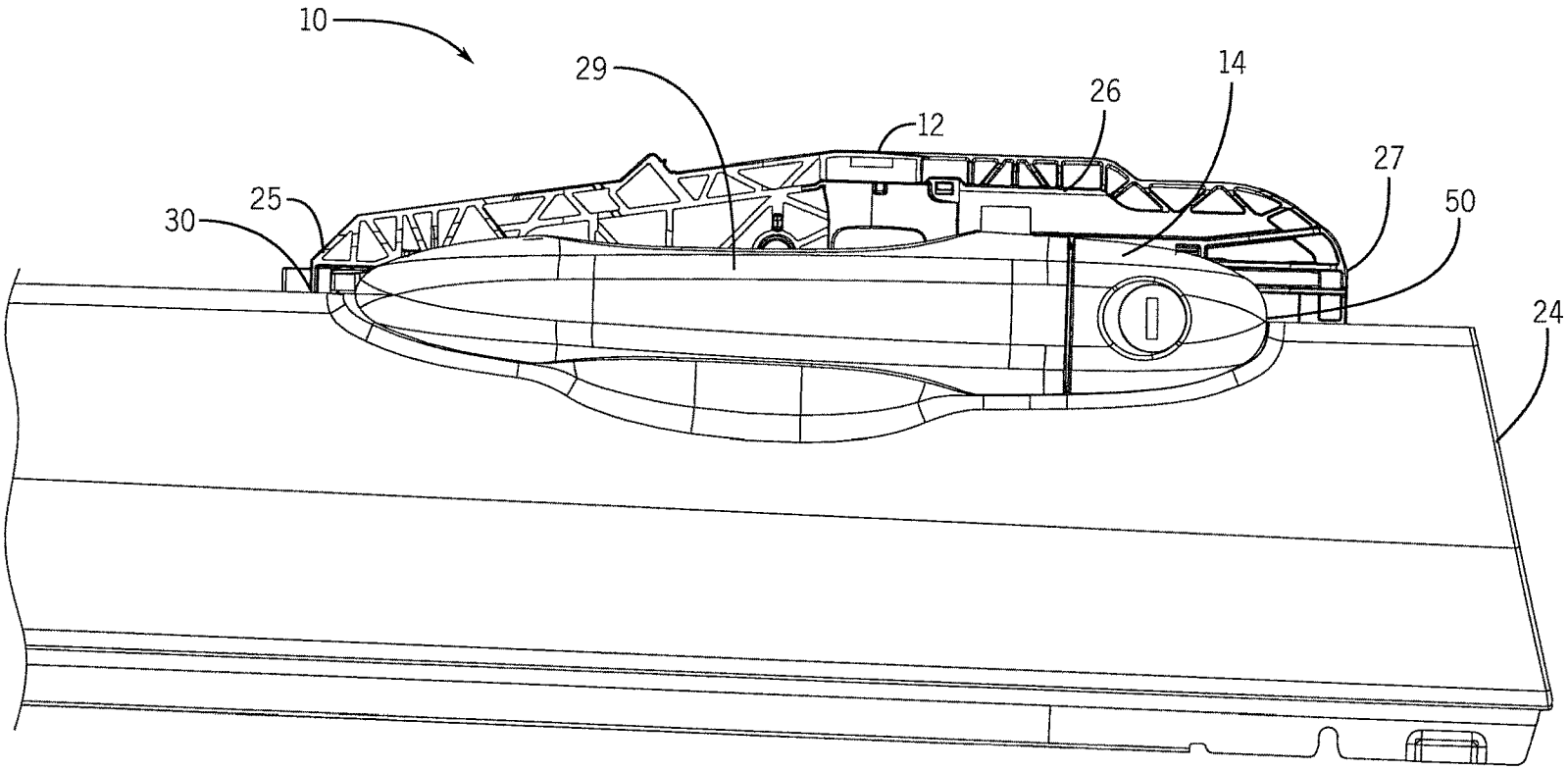
FIG. 3 is a side view of a bracket coupled to a door panel and including a handle strap in which the bracket and strap together establish the completed door handle assembly that is installed in the door.

As shown in FIGS. 1 and 2, the present disclosure provides a door handle assembly 10 including a bracket 12, an insertion member 14, a retaining mechanism 16, and a door retaining member 22. The retaining mechanism 16 further includes a biasing member 18 and a movable locking member 20. As shown in FIG. 3, the bracket 12 may be affixed to a vehicle door 24 (it is noted the upper half of the door is not illustrated to better show the bracket 12 beneath it). The bracket 12 extends along a longitudinal direction and includes a forward end 25 having a hook portion 31 (best seen in FIGS. 4A and 4B) that engages the door 24 and a rearward end 27, which includes the insertion member 14, the retaining mechanism 16, and the door retaining member 22 that are illustrated in FIGS. 1 and 2. The bracket 12 may be designed or adapted to be mounted to the door 24 of a vehicle and is used to support a handle strap 29.

Figure 4A:
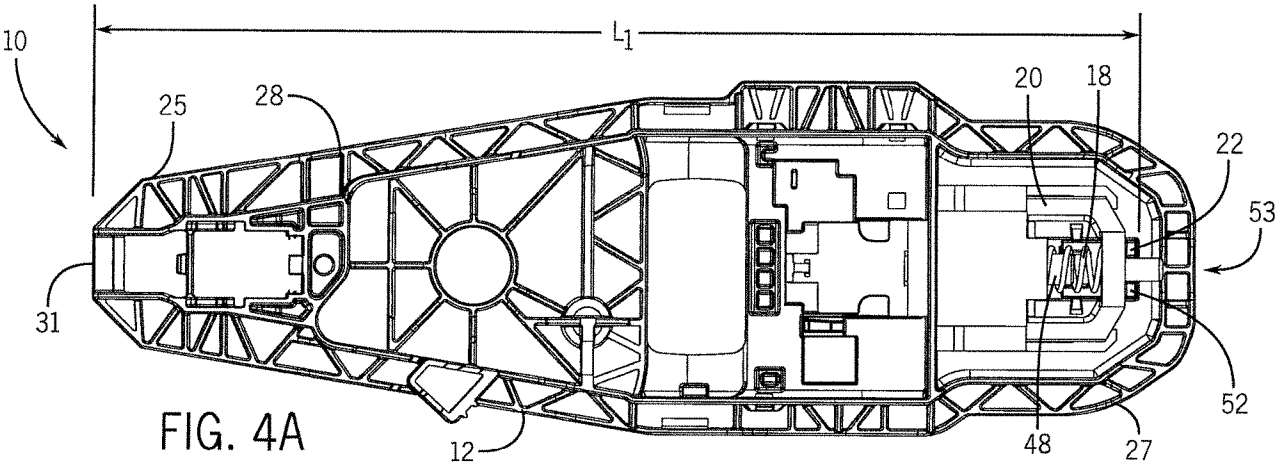
FIG. 4A is a back side view of a bracket with a door retaining member in a home position.
Figure 4B:
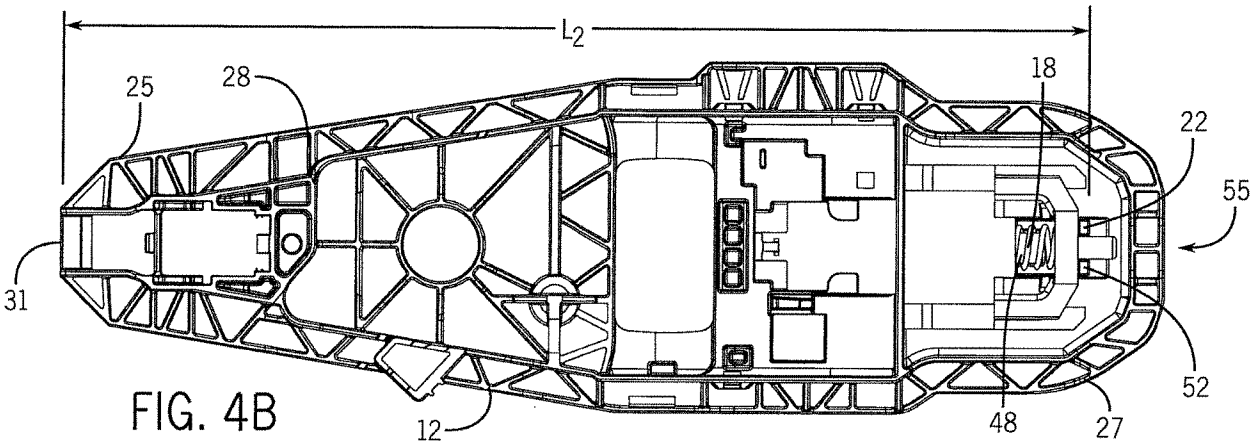
FIG. 4B is a back side view of the bracket of FIG. 4A with the door retaining member in a displaced position.

As illustrated in FIGS. 4A and 4B, the hook portion 31 may be fixed relative to the forward end 25 of the bracket 12. The hook portion 31, in the form illustrated, is a forward facing hook that is integral with the bracket 12. In an alternative embodiment, the hook portion 31 may be a separate component that attaches to the forward end 25 of the bracket 12 via any suitable adhesives, fasteners, or the like. The hook portion 31 may be rotatable about a hook receiving portion 30 on the door 24 to mount the bracket 12 to the door 24, as will be described in further detail below.

Figure 5:
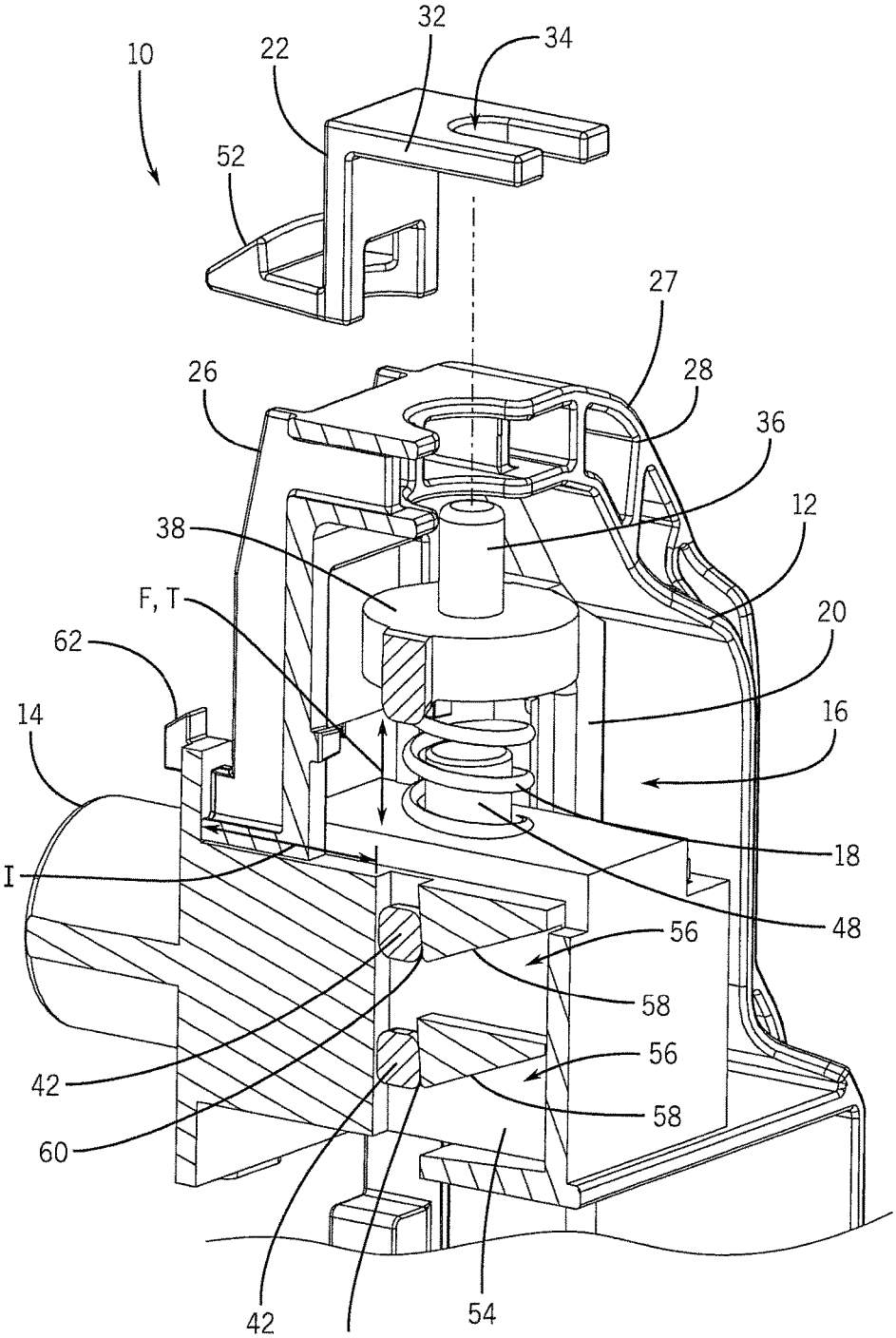
FIG. 5 is a partial cross-sectional view of the door handle assembly taken along line 5-5 of FIG. 2.
Figure 6:
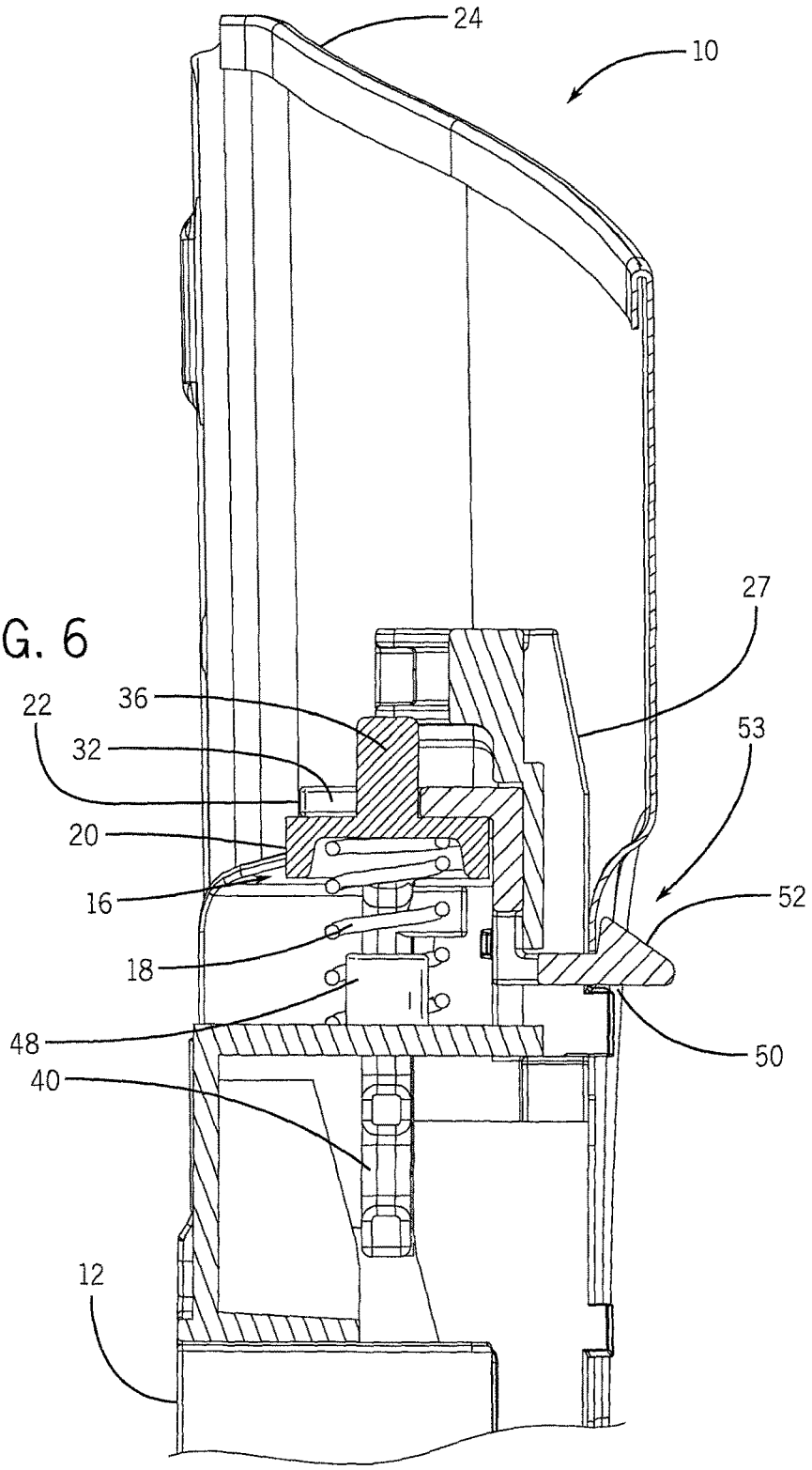
FIG. 6 is a top-down partial cross-sectional view of the door handle assembly of FIG. 1 secured to a door panel utilizing a door retaining member.

The door retaining member 22, as shown in FIG. 5, is a generally Z-shaped component and is received proximate the rearward end 27 of the bracket 12. The door retaining member 22 includes a clip portion 52 that extends from a base portion 32 thereof. The clip portion 52 is movable relative to the bracket 12 and is adapted to secure the bracket 12 to the door panel 24 at the rearward end 27, as shown in FIG. 6. In the form illustrated, the clip portion 52 is a rear-facing hook, as opposed to the forward-facing hook portion 31, and together they are used to assemble the bracket 12 to the door 24.

The clip portion 52 is moveable relative to the bracket 12 between a home position 53, as shown in FIG. 4A, and a displaced position 55, as shown in FIG. 4B. In the home position 53, a first longitudinal distance $L_1$ is established between the clip portion 52 and the hook portion 31, as shown in FIG. 4A. In the displaced position 55, a second longitudinal distance $L_2$ is established between the clip portion 52 and the hook portion 31, as shown in FIG. 4B.

In some configurations, the first longitudinal distance $L_1$ between the clip portion 52 and the hook portion 31 is greater than the second longitudinal distance $L_2$, as illustrated in FIGS. 4A and 4B. This is due to the translational, linear movement of the door retaining member 22 along the longitudinal direction between the home position 53 and the displaced position 55. However, in one alternative form, the movement of the door retaining member 22 between the home position 53 and the displaced position 55 may be rotational and not purely linear translation as illustrated; in this instance, the door retaining member may be made to be rotational about an axis of rotation and biased towards an engagement position by a biasing member.

Turning to FIG. 5, the door retaining member 22 further includes an opening 34 extending through the base portion 32 that is configured to receive a post or shaft 36 of the movable locking member 20. Thus, the movable locking member 20 and the door retaining member 22 are each movable by and biased by the biasing member 18 on the rearward end 27 of the bracket 12. More specifically, the biasing member 18 is designed to bias the door retaining member 22 toward the home position 53 and permit movement of the door retaining member 22 against the biasing member 18 to the displaced position 55.

Figure 8:
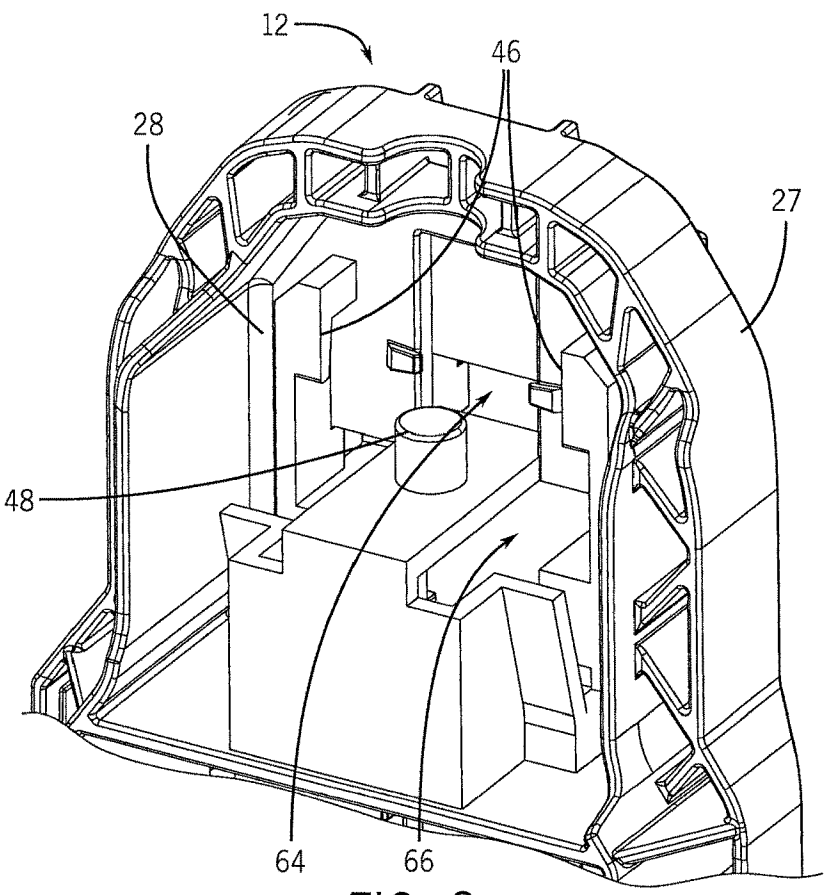
FIG. 8 is a rear perspective view of a rearward portion of the bracket of the door handle assembly of FIG. 1 without a door retaining member, a movable locking member, a biasing member, or an insertion member illustrated.
Figure 7:
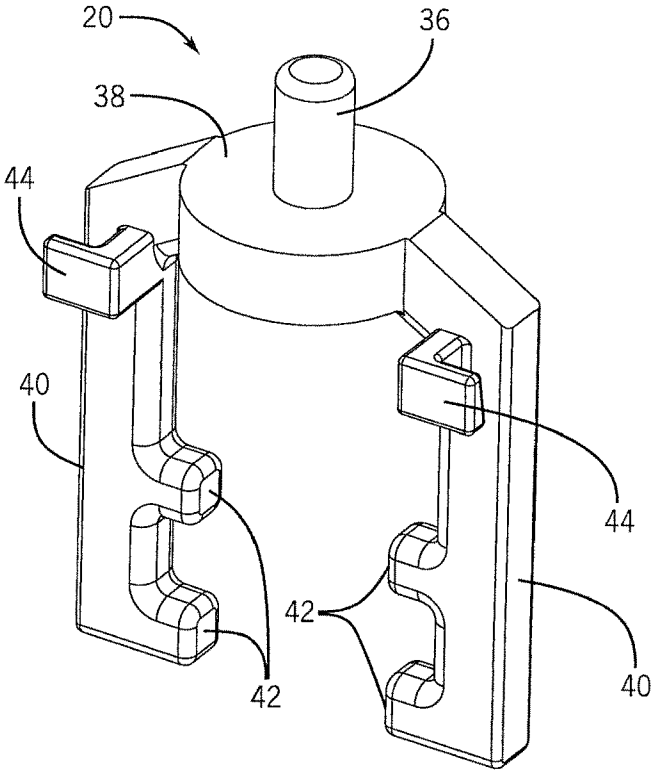
FIG. 7 is a perspective view of a movable locking member of the door handle assembly of FIG. 1.

As shown in FIG. 7, the movable locking member 20 is generally U-shaped having a base 38 with two spaced legs 40 projecting therefrom. Each of the legs 40 has a pair of inwardly facing projections 42 that are adapted for engagement with the insertion member 14, as will be described in greater detail below. Each of the legs 40 also includes an outwardly facing projection 44 that is adapted for engagement with corresponding receiving grooves 46 on a rear portion 28 of the bracket 12, as illustrated in FIG. 8.

The base 38 of the movable locking member 20 is adapted to receive one end of the biasing member 18, which is a coil spring in the form illustrated in FIG. 1 (and FIG. 6 in which a slight receiving recess is illustrated in section). While a coil spring is shown, in alternative configurations, the biasing member 18 may take other forms. Opposite the end received in the movable locking member 20, the other end of the biasing member 18 surrounds and contacts a post 48 positioned on the rear portion 28 of the bracket 12, as shown in FIGS. 1 and 5. The position of the biasing member 18 creates a biasing force F between the bracket 12 and the movable locking member 20 that causes the movable locking member 20 and, thus, the door retaining member 22, which is received on the end of the movable locking member 20, to be biased toward the home position 53 as illustrated in FIG. 4A.

In the form illustrated, the movable locking member 20 and the door retaining member 22 are generally restricted to linear translational movement in the directions as indicated by arrow T in FIG. 5. This restriction in motion is caused by the way the movable locking member 20 and the door retaining member 22 are received in the bracket 12 and can be the result of the movable locking member 20 being seated in a groove or channel in the bracket 12. The movable locking member 20 is biased by the biasing member 18 in the home position 53 or locking position as shown in FIG. 5. If a sufficient force is applied to overcome the biasing force F supplied by the biasing member 18, the movable locking member 20 can move in a forward direction and toward the position shown in FIG. 4B.

As shown in FIG. 2, the insertion member 14 may be received on a front portion 26 of the bracket 12 and extend into the rear portion 28 of the bracket 12 in which the insertion member 14 engages the retaining mechanism 16 (and more specifically the movable locking member 20) to secure the insertion member 14 in the bracket 12. The insertion member 14 may be, may include, or may support a lock cylinder or cover cap that is received and retained in the bracket 12 by use of the retaining mechanism 16 and the movable locking member 20 in particular. Whether a lock cylinder or cover cap is used in a particular assembly depends on the specific details of the specific door handle assembly and vehicle design. For example, in most driver side doors having keyed entry, a lock cylinder or supporting housing would be inserted into the bracket 12 at this location. However, for certain front and rear passenger side doors, in which directed keyed entry is not available or desired, a cover cap may alternatively be inserted instead of a lock cylinder in order to complete the handle assembly.

Figure 9:
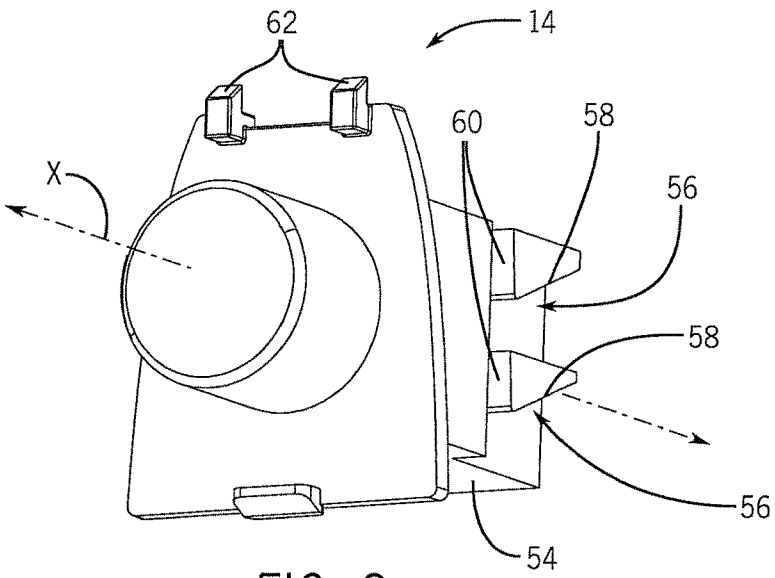
FIG. 9 is a perspective view of an insertion member of the door handle assembly of FIG. 2.

Referring to FIG. 9, the insertion member 14 is illustrated in isolation and includes a base end 54 having two opposing lateral sides each having a pair of recesses 56 formed therein that receive the projections 42 on the legs 40 of the movable locking member 20, as illustrated in FIG. 5. The recesses 56 have cam or ramped surfaces 58 on a bottom end thereof and cutback sections 60 on a side end thereof. The shape of the ramped surfaces 58 along with corresponding projections 42 result in the displacement of the movable locking member 20 against the biasing force of the biasing member 18 during the axial insertion of the insertion member 14 in the region of the ramped surfaces 58 and projections 42 interfere with, bear on, or engage one another. In the region of the cutback sections 60, there is sufficient room for the movable locking member 20 to return or to snap back to a securing position as the projections 42 no longer act against the biasing force as they did in the region of the ramps 58. More specifically, the insertion of the insertion member 14 into the bracket 12 may cause the movable locking member 20 to temporarily overcome the biasing force of the biasing member 18 over a portion of an insertion distance I, as illustrated in FIG. 5, until the insertion member 14 is fully received in the bracket 12. At this point, the biasing force F causes the movable locking member 20 to snap back and lock in place, thereby causing the movable locking member 20 to retain the insertion member 14 in the bracket 12 and not be readily withdrawn (unless a separate manual operation is performed to move the movable locking member 20 back out of the biased position illustrated in FIG. 1, for example).

As illustrated in FIG. 9, the insertion member 14 further includes a pair of hooks 62 disposed along an engagement surface 63 (which is denoted in FIG. 2). The hooks 62 are configured to help retain the cosmetic cap to the lock. An aperture 64 in the bracket 12 may also extend from the front portion 26 to the rear portion 28 of the bracket 12, as shown in FIG. 2, to receive the clip portion 52 of the door retaining member 22 and further secure the door handle assembly 10 to the vehicle door 24.

As shown in FIG. 2, the engagement surface 63 of the insertion member 14 is proximate the forward end 25 of the bracket 12. The engagement surface 63 may be designed to engage the clip portion 52 of the door retaining member 22 as the insertion member 14 is received in the bracket 12. Once the insertion member 14 is received in the bracket 12, the engagement surface 63 may inhibit the door retaining member 22 from moving out of the home position 53 in the longitudinal direction because the clip portion 52 abuts the engagement surface 63 while the insertion member 14 is in the secured position. This can be helpful because as the door retaining member 22 will first be used to assemble the bracket 12 into the door or sheet metal and, with the bracket 12 assembled into place, the insertion member 14 will be inserted. During each of these two steps, the biasing force of the biasing member 18 will need to be overcome, respectively, to move the door retaining member 22 from the home position during installation of the bracket and then again to move the movable locking member 20 during the insertion of the insertion member 14. To avoid disengagement of the door retaining member 22 during the insertion of the insertion member 14, it can be helpful for the insertion member 14 to substantially inhibit the door retaining member 22 from moving out of an engaged position.

During assembly, the hook portion 31 on the forward end 25 of the bracket 12 is first received at the hook receiving portion 30 of the door 24, as illustrated in FIG. 3. The bracket 12 may then be rotated about the hook portion 31 until the clip portion 52 is received in the clip receiving portion 50 of the door 24, as illustrated in FIG. 6. The clip receiving portion 50 may be in the form of an aperture or access hole that is dimensioned to receive the clip portion 52. As the clip portion 52 passes through the clip receiving portion 50 of the door 24, the door retaining member 22 is temporarily longitudinally moved from the home position 53 to the displaced position 55. As the clip portion 52 moves from the home position 53 to the displaced position 55, a spatial displacement of the door retaining member 22 away from the home position 53 compresses the biasing member 18 and coincidentally translates the movable locking member 20 forward as the door retaining member 22 moves against the biasing member 18 to the displaced position 55.

After the head of the clip portion 52 has passed through the clip receiving portion 50 of the door 24, the door retaining member 22 can return or snap back under the biasing force to the home position 53 to secure the bracket 12 to the door 24. The bracket 12 is secured to the door 24 by the combination of the hook portion 31 and the door retaining member 22. Thus, as just described, the bracket 12 is mountable to the door 24 without the use of tools by an assembler.

Figure 10:
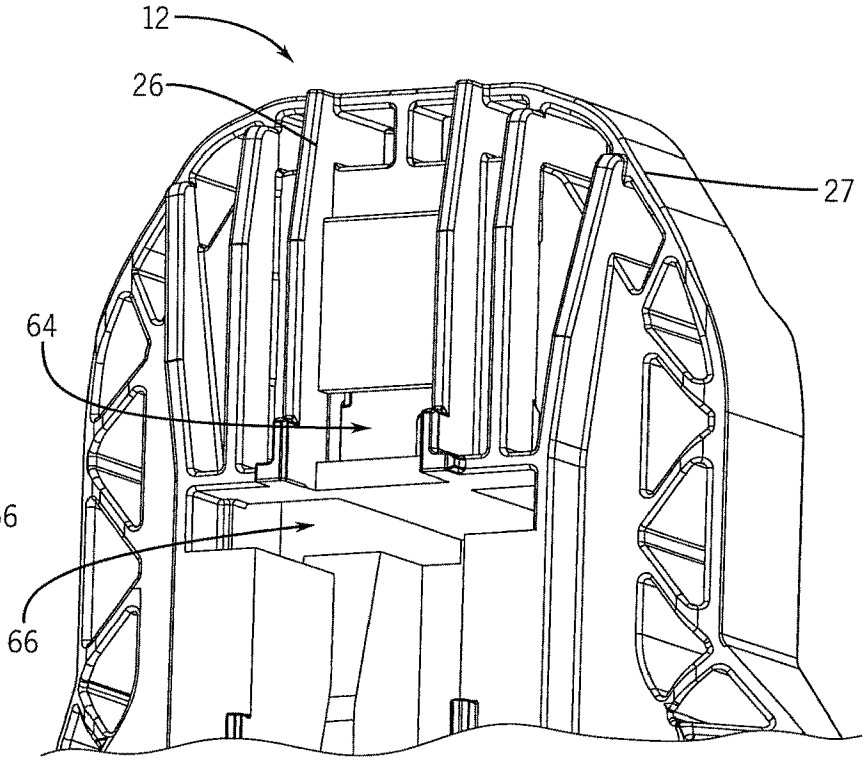
FIG. 10 is a front perspective view of a rearward portion the bracket of the door handle assembly of FIG. 2.

Once the door retaining member 22 returns to the home position 53, the insertion member 14 is inserted base end 54 first into an opening 66 of the bracket 12, as shown in FIGS. 9 and 10, along a direction of insertion which is parallel with a central axis X of the insertion member 14, shown in FIG. 2. For context, the direction of insertion is generally perpendicular to the exterior side of the door 24 in most handle assemblies as well as to the direction of translation movement of the movable locking member 20.

As the base end 54 of the insertion member 14 is inserted into the opening 66 of the bracket 12, the projections 42 on the legs 40 of the movable locking member 20 engage and bear on the ramped surfaces 58 of the insertion member 14. As the insertion member 14 continues along the direction of insertion, this engagement of the projections 42 and the ramped surfaces 58 cause the movable locking member 20 to be displaced relative to the bracket 12 against the biasing force. This displacement occurs as the force applied during the insertion of the insertion member 14 causes the ramped surfaces 58 to interfere with the projections 42 in an amount sufficient to overcome the biasing force applied by the biasing member 18.

After the insertion member 14 has been inserted to an insertion depth past which the projections 42 engage the ramped surfaces 58, then the projections 42 are able to recoil back into the cutback sections 60 of the recesses 56, as illustrated in FIG. 5, permitting the movable locking member 20 to travel back to the secure or locking position due to the unobstructed biasing force applied by the biasing member 18. This movement of the movable locking member 20 into the securing position within the bracket 12 prevents the insertion member 14 from being withdrawn back out of bracket 12 as the projections 42 of the movable locking member 20 would engage the cutback sections 60 and prevent the insertion member 14 from being removed from the opening 66.

In an alternative configuration, the door retaining member 22 may be integrally formed with the movable locking member 20. In this instance, they would move together and this single piece might perform the functions of both attaching the bracket to the door frame or sheet and of accepting and retaining the insertion member 14.

While the form of the disclosure depicted in FIGS. 1 through 10 involves the linear translation of the movable locking member (which is suitable to achieve the selective securing function described herein in conjunction with the insertion member), it is contemplated that other types of biased locking members might be used in order to achieve the same functionality without departing from the scope of the disclosure. For example, the movable locking member may be constructed to rotate, rather than linearly translate when the movable locking member interacts with the insertion member during assembly. Such rotation might occur in a plane parallel with the plane of translation in the illustrated configuration or may occur outside of this plane. In such a situation, the insertion member would have a corresponding geometry that engages with the rotating elements to permit insertion of the insertion member to overcome the biasing force, but upon full insertion of the insertion member, cause the rotating elements to (at least temporarily) lock, retain, and secure the insertion member relative to the bracket.

Other variations to the retaining mechanism are contemplated. For example, the movable locking member may be a unitary item or comprise multiple separately movable members. Still yet, it is contemplated that the movable locking member and the biasing member may either be separate from one another, as illustrated, or be combined with one another in a manner in which the biasing member is integrally formed with the movable locking member. Additionally, the biasing member may take forms other than a coiled spring such as, for example, a leaf spring. Other non-spring biasing mechanisms may also be used such as for example mechanisms involving magnets, compressible hydraulic elements, temporarily deformable elements, and so forth.

It is also contemplated that the arrangements of the engaging elements on the movable locking member and the insertion member may be reversed or altered in shape. For example, one might reverse the placement of projections and recesses on the movable locking member and the insertion member. Further, rather than one member having projections and the other recesses with profiled surfaces, both members may have projections or profiled surfaces that contact one another. It is observed that, even in the illustrated embodiment, the recesses formed on the sides of the insertion member actually create projections as defined from the bottom of the recesses. In any event, one having ordinary skill in the art will appreciate that the specific geometries and arrangement of the engaging features may be altered to achieve a similar displace-and-lock effect described in the assembly described above.

The foregoing description of the embodiments has been provided for purposes of illustration and description. It is not intended to be exhaustive or to limit the disclosure. Individual elements or feature of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

We claim:

1. A door handle assembly for a door, the door handle assembly comprising:

a bracket mountable to the door and extending along a longitudinal direction from a forward end to a rearward end, the forward end of the bracket providing a hook portion;

a door retaining member received proximate the rearward end of the bracket, the door retaining member having a clip portion that is moveable relative to the bracket between a home position in which a first longitudinal distance is established between the clip portion and the hook portion and a displaced position in which a second longitudinal distance is established between the clip portion and the hook portion, the first longitudinal distance is different than the second longitudinal distance; and a resilient biasing member resiliently biasing the clip portion toward the home position and permitting movement of the clip portion against the resilient biasing member to the displaced position.

2. The door handle assembly of claim 1, wherein the hook portion is fixed relative to the bracket.

3. The door handle assembly of claim 1, wherein the second longitudinal distance is less than the first longitudinal distance.

4. The door handle assembly of claim 1, further comprising a locking member movable relative to the bracket between an extended position and a retracted position.

5. The door handle assembly of claim 4, wherein the locking member is biased into the extended position by the resilient biasing member.

6. The door handle assembly of claim 5, wherein the locking member is fixed for movement with the door retaining member.

7. The door handle assembly of claim 5, further comprising an insertion member operably supporting a component of the handle assembly, the insertion member including a retention feature that engages the locking member to attach the insertion member to the bracket.

8. The door handle assembly of claim 7, wherein the insertion member includes at least one ramped surface operable to engage the locking member to move the locking member from the extended position to the retracted position against the bias exerted on the locking member by the resilient biasing member.

9. The door handle assembly of claim 8, wherein the locking member disengages the at least one ramped surface when the insertion member is moved a predetermined distance into the bracket and returns to the extended position to attach the insertion member to the bracket.

10. The door handle assembly of claim 7, wherein the component of the handle assembly is at least one of a lock cylinder and a cover cap.

11. A door handle assembly for a door, the door handle assembly comprising:

a bracket mountable to the door;

a door retaining member including a clip portion that is moveable relative to the bracket between a home position and a displaced position, the clip portion operable to attach the bracket to the door in the home position;

a locking member supported by the bracket and movable between an extended position and a retracted position, the locking member operable to attach a component of the door handle assembly to the bracket in the extended position; and a resilient biasing member resiliently biasing the clip portion toward the home position and permitting movement of the clip portion against the resilient biasing member to the displaced position and biasing the locking member toward the extended position and permitting movement of the locking member against the resilient biasing member to the retracted position.

12. The door handle assembly of claim 11, wherein the bracket includes a hook portion operable to engage the door proximate to a first end of the bracket.

13. The door handle assembly of claim 12, wherein the hook portion is fixed relative to the bracket.

14. The door handle assembly of claim 13, wherein a first longitudinal distance is established between the clip portion and the hook portion when the clip portion is in the home position and a second longitudinal distance is established between the clip portion and the hook portion when the clip portion is in the displaced position, the first longitudinal distance being different than the second longitudinal distance.

15. The door handle of assembly of claim 14, wherein the first longitudinal distance is greater than the second longitudinal distance.

16. The door handle assembly of claim 11, wherein the locking member is fixed for movement with the door retaining member.

17. The door handle assembly of claim 11, further comprising an insertion member operably supporting the component of the handle assembly, the insertion member including a retention feature that engages the locking member to attach the insertion member to the bracket.

18. The door handle assembly of claim 17, wherein the insertion member includes at least one ramped surface operable to engage the locking member to move the locking member from the extended position to the retracted position against the bias exerted on the locking member by resilient the biasing member.

19. The door handle assembly of claim 18, wherein the locking member disengages the at least one ramped surface when the insertion member is moved a predetermined distance into the bracket and returns to the extended position to attach the insertion member to the bracket.

20. The door handle assembly of claim 17, wherein the component of the handle assembly is at least one of a lock cylinder and a cover cap.

* * * * *